US010800012B2

(12) United States Patent
Cheng

(10) Patent No.: US 10,800,012 B2
(45) Date of Patent: Oct. 13, 2020

(54) RATCHET HEAD WITH SAFETY SWITCH MECHANISM

(71) Applicant: Ming Ta Cheng, Taichung (TW)

(72) Inventor: Ming Ta Cheng, Taichung (TW)

( * ) Notice: Subject to any disclaimer, the term of this patent is extended or adjusted under 35 U.S.C. 154(b) by 359 days.

(21) Appl. No.: 15/810,973

(22) Filed: Nov. 13, 2017

(65) Prior Publication Data

US 2019/0143490 A1 May 16, 2019

(51) Int. Cl.
*B25B 13/46* (2006.01)

(52) U.S. Cl.
CPC ..... *B25B 13/463* (2013.01); *B25B 13/465* (2013.01); *B25B 13/468* (2013.01)

(58) Field of Classification Search
CPC ..... B25B 13/463; B25B 13/468; B25B 15/04; B25B 13/465; B25B 23/0035
USPC ..... 81/57.39, 60, 61, 62, 63, 63.1, 63.2
See application file for complete search history.

(56) References Cited

U.S. PATENT DOCUMENTS 5,603,393 A * 2/1997 Ghode ..... B25B 13/461 81/62
6,923,095 B2 * 8/2005 Horvath ..... B25B 21/004 81/57
8,770,066 B2 * 7/2014 Chang ..... B25B 13/463 81/63
2005/0011314 A1 * 1/2005 Chen ..... B25B 13/463 81/63
2009/0301266 A1 * 12/2009 Hu ..... B25B 13/465 81/62
2016/0279767 A1 * 9/2016 Cheng ..... B25B 13/465

* cited by examiner

*Primary Examiner* — Monica S Carter
*Assistant Examiner* — Alberto Saenz
(74) *Attorney, Agent, or Firm* — Muncy, Geissler, Olds & Lowe, P.C.

(57) ABSTRACT

A ratchet head has a mount, a knob, and a restricting unit. The mount has an assembling hole, and two positioning recesses disposed on both sides of the assembling hole. The two positioning recesses are parallel to each other and communicate with the assembling hole. The knob is rotatably assembled to the mount and has a shaft inserted in the assembling hole and having an abutting section with two first abutting faces and two second abutting faces. The two first abutting faces are parallel to each other. The two second abutting faces are parallel to each other. The restricting unit with elasticity has two arms respectively mounted in the two positioning recesses, respectively disposed on both sides of the shaft, and respectively abutting against the two first abutting faces that respectively face to the two positioning recesses. The restricting unit is able to steadily maintain the operating directions of the ratchet head.

11 Claims, 8 Drawing Sheets

RATCHET HEAD WITH SAFETY SWITCH MECHANISM

BACKGROUND OF THE INVENTION

1. Field of the Invention

The present invention relates to a hand tool, and more particularly to a ratchet head with a safety switch mechanism for preventing the ratchet head from accidentally switching operating directions.

2. Description of Related Art

With reference to FIGS. 7 and 8, a conventional ratchet head 90 for a ratchet wrench has a knob with a shaft 91 and an abutting unit 92 radially assembled through the shaft 91. The abutting unit 92 has a ball 93 arranged at an end of the abutting shaft 91. The ball 93 abuts against a pawl 94 with two switching recesses 95. The knob is rotated and the ball 93 of the abutting unit 92 abuts against one of the two switching recesses 95 to force the conventional ratchet head 90 to operate in a direction. When the ball 93 of the abutting unit 92 abuts against the other one of the two switching recesses 95, the conventional ratchet head 90 is restricted to operate in an opposite direction.

The conventional ratchet head 90 utilizes the ball 93 to abut against one of the two switching recesses 95 for maintaining operating directions of the conventional ratchet head 90. However, the ball 93 easily detaches from any one of the two switching recesses 95 due to vibrations during operation. The operating directions of the conventional ratchet head 90 may be easily switched and cause unexpected hazard and damages.

To overcome the shortcomings of the conventional ratchet head, the present invention provides a ratchet head with a safety switch mechanism to mitigate or obviate the aforementioned problems.

SUMMARY OF THE INVENTION

The main objective of the present invention is to provide a ratchet head capable of steadily maintaining the operating directions.

The ratchet head comprises a mount, a knob, and a restricting unit. The mount has an assembling hole, and two positioning recesses disposed on both sides of the assembling hole. The two positioning recesses are parallel to each other and communicate with the assembling hole. The knob is rotatably assembled to the mount and has a shaft inserted in the assembling hole and having an abutting section with two first abutting faces and two second abutting faces. The two first abutting faces are parallel to each other. The two second abutting faces are parallel to each other. The restricting unit with elasticity has two arms respectively mounted in the two positioning recesses, respectively disposed on both sides of the shaft, and respectively abutting against the two first abutting faces that respectively face to the two positioning recesses. The restricting unit is able to steadily maintain the operating directions of the ratchet head.

Other objects, advantages, and novel features of the invention will become more apparent from the following detailed description when taken in conjunction with the accompanying drawings.

DETAILED DESCRIPTION OF PREFERRED EMBODIMENT

Figure 1:
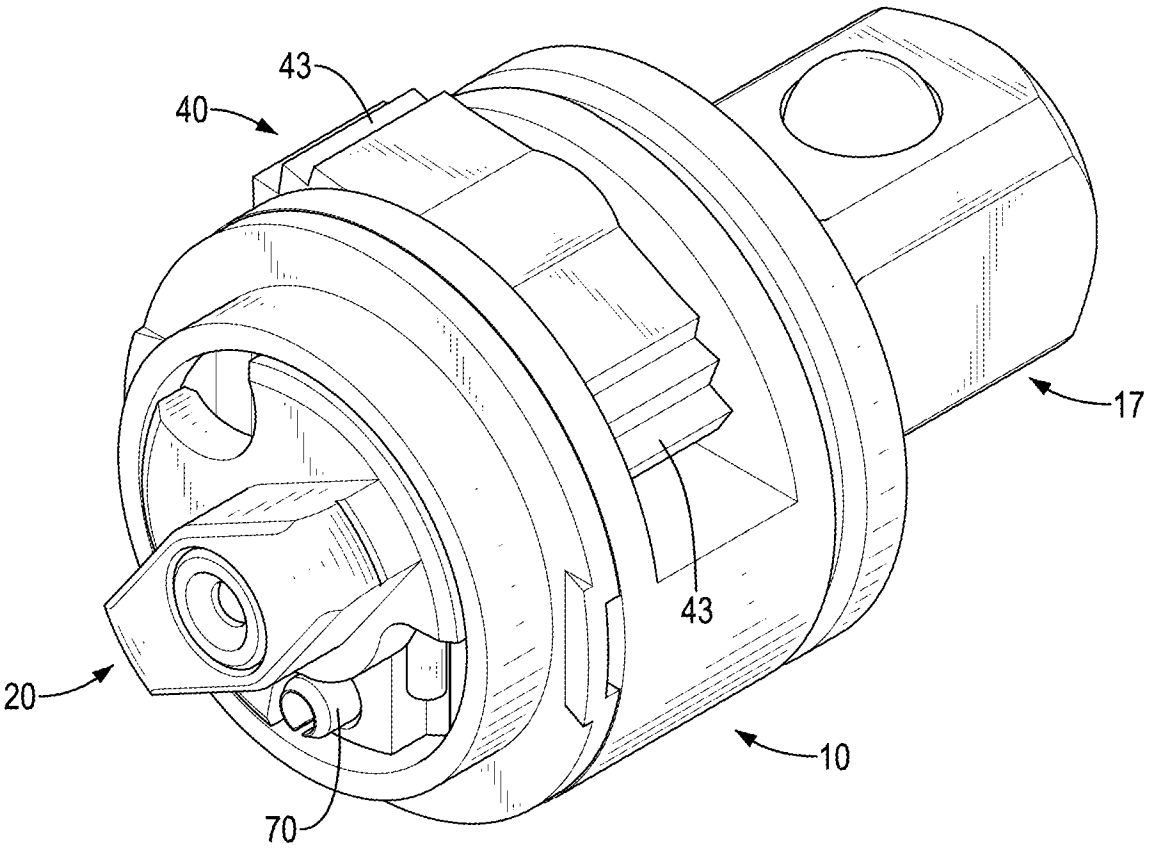
FIG. 1 is a perspective view of a ratchet head in accordance with the present invention.
Figure 2:
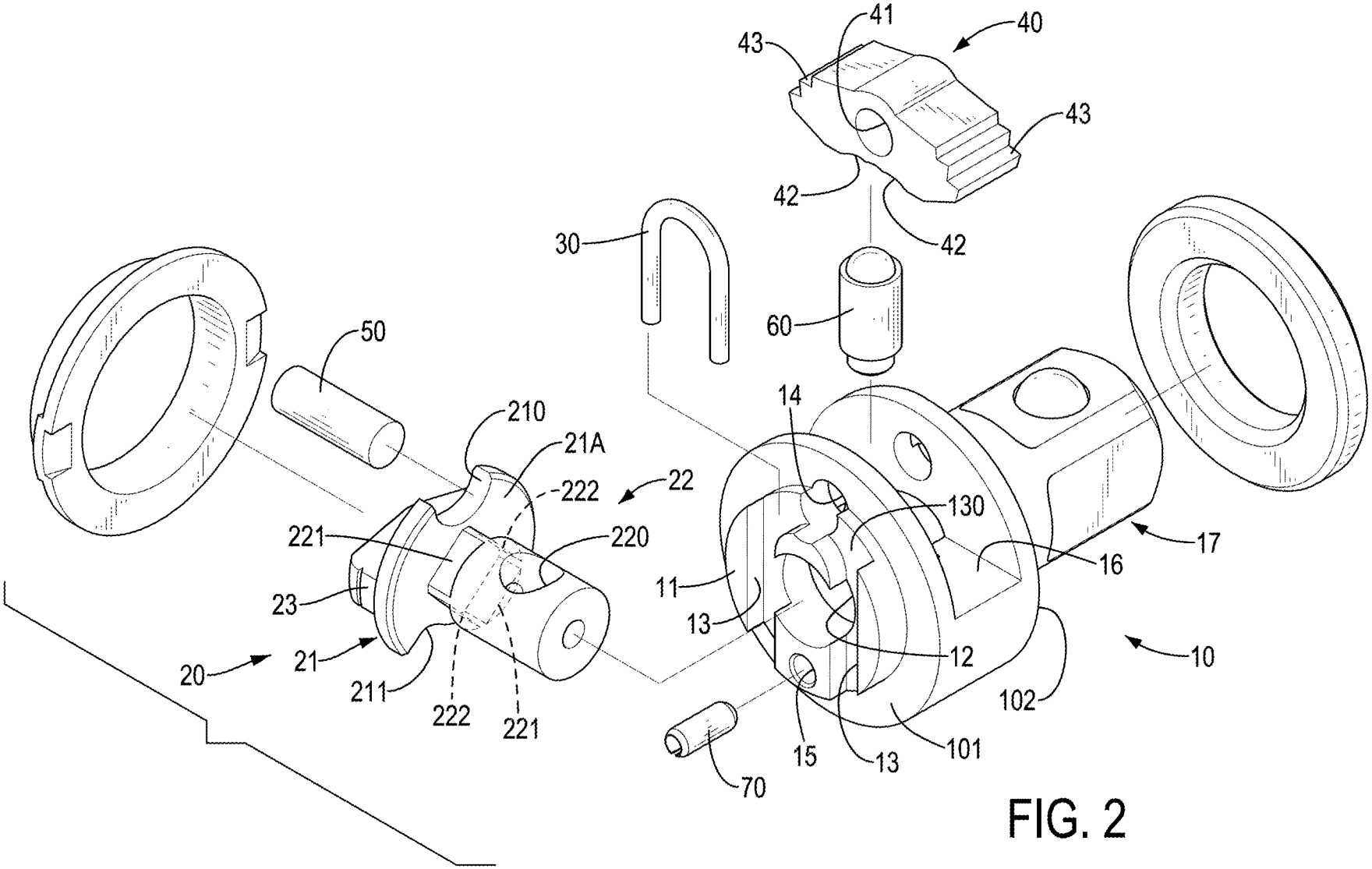
FIG. 2 is an exploded perspective view of the ratchet head in FIG. 1.

The present invention provides a ratchet head with safety switch mechanism. With reference to FIGS. 1 and 2, a ratchet head in accordance with the present invention has a mount 10, a knob 20, a restricting unit 30, a pawl 40, a pivoting rod 50, an abutting unit 60, and a limiting rod 70. The mount 10 is a stepped structure and has a first lateral face 101, a second lateral face 102, a round surface, an axial direction, a positioning portion 11, an assembling hole 12, two positioning recesses 13, a pivoting hole 14, an inserting hole 15, a receiving recess 16, and a square drive 17. The first lateral face 101 and the second lateral face 102 of the mount 10 face to opposite directions With reference to FIGS. 1 and 2, the positioning portion 11 protrudes from the first lateral face 101 of the mount 10. The assembling hole 12 is defined in a center of the positioning portion 11. The two positioning recesses 13 are disposed on both sides of the assembling hole 12. The two positioning recesses 13 may communicate with each other to form a U-shaped groove 130. In FIG. 2, the pivoting hole 14 is defined in the positioning portion 11 and is disposed above the assembling hole 12. The inserting hole 15 is defined in the positioning portion 11 and disposed below the assembling hole 12. The pivoting hole 14 and the inserting hole 15 are adjacent to an edge of the positioning portion 11. The receiving recess 16 is defined in the round surface of the mount 10. The receiving recess 16 has a semi-circular cross-section, extends along the axial direction of the mount 10, and communicates with the assembling hole 12 and the pivoting hole 14. The square drive 17 is utilized to connect and drive a socket. The square drive 17 protrudes from the second lateral face 102 of the mount 10. The assembling hole 12 extends parallel to the square drive 17. The square drive 17 and the positioning portion 11 are disposed at two opposite ends of the mount 10. Therefore, the receiving recess 16 is disposed between the positioning portion 11 and the square drive 17.

With reference to FIGS. 1 and 2, the knob 20 is rotatably assembled to the assembling hole 12 of the mount 10. The knob 20 has a blocking flange 21, a shaft 22, and an operating portion 23. The blocking flange 21 abuts against the positioning portion 11 and has an outline of a disk, an inner surface 21A, an outer surface 21B, a connection recess 210, and a limiting recess 211. The inner surface 21A and the outer surface 21B of the blocking flange 21 face to opposite directions. The inner surface 21A of the blocking flange 21 faces to the mount 10 as the knob 20 is assembled to the mount 10. The connection recess 210 is disposed according to the position of the pivoting hole 14. The limiting recess 211 is disposed according to the position of the inserting hole 15. The limiting recess 211 is curved.

With reference to FIGS. 1, 2, and 4 to 6, the shaft 22 is integrally formed at a center of the inner surface 21A of the blocking flange 21. The shaft 22 is inserted in the assembling hole 12, extends in the receiving recess 16, and has a circumference, an abutting section, and a hole 220. The abutting section of the shaft 22 is formed on the circumference of the shaft 22 and disposed adjacent to the blocking flange 21. The abutting section of the shaft 22 has two first abutting faces 221 and two second abutting faces 222 disposed at the circumference of the shaft 22. The two first abutting faces 221 are parallel to each other. The two second abutting faces 222 are parallel to each other.

In the embodiment of the present invention, the abutting section of the shaft 22 has a square cross-section. The two first abutting faces 221 and the two second abutting faces 222 are four faces of the abutting section of the shaft 22. The cross-section of the abutting section of the shaft 22 may be a rhombus or parallelogram in shape. The hole 220 is defined in the circumference of the shaft 22 according to the position of the receiving recess 16. The operating portion 23 is formed on the outer surface 21B of the blocking flange 21 and has a bar-shaped outline for user to operate.

The restricting unit 30 is elastic and has a U-shaped outline, a round cross-section, and two arms. The restricting unit 30 is assembled to the mount 10. The two arms of the restricting unit 30 are respectively mounted in the two positioning recesses 13 of the mount 10, and respectively abut against the two first abutting faces 221 that respectively face to the two positioning recesses 13. The two arms of the restricting unit 30 securely clamp the abutting section of the shaft 22 of the knob 20 to prevent the knob 20 from rotating relative to the mount 10 due to vibration. Each one of the two arms has a diameter smaller than a width of the positioning recess 13 in which said arm is mounted.

The pawl 40 is swingably mounted in the receiving recess 16 of the mount 10. The pawl 40 has a through hole 41, two toothed portions 43, and two switching recesses 42. The two switching recesses 42 face to the hole 220 of the shaft 22. The pivoting rod 50 passes through the connection recess 210 of the blocking flange 21 of the knob 20 and then is inserted in the pivoting hole 14 of the mount 10 and the through hole 41 of the pawl 40. The pawl 40 may be swung to select the operating direction of the ratchet head.

The abutting unit 60 is mounted through the hole 220 of the shaft 22, disposed in the receiving recess 16 of the mount 10, and has two opposite ends. One of the two opposite ends of the abutting unit 60 is inserted in the hole 220 of the shaft 22 of the knob 20. The other one of the two opposite ends of the abutting unit 60 selectively abuts against one of the two switching recess 42 of the pawl 40. The limiting rod 70 is inserted in the inserting hole 15 and is disposed in the limiting recess 211. The limiting rod 70 may block the blocking flange 21 of the knob 20 to restrict the rotating range of the knob 20 when switching the operating directions of the ratchet head.

Figure 3:
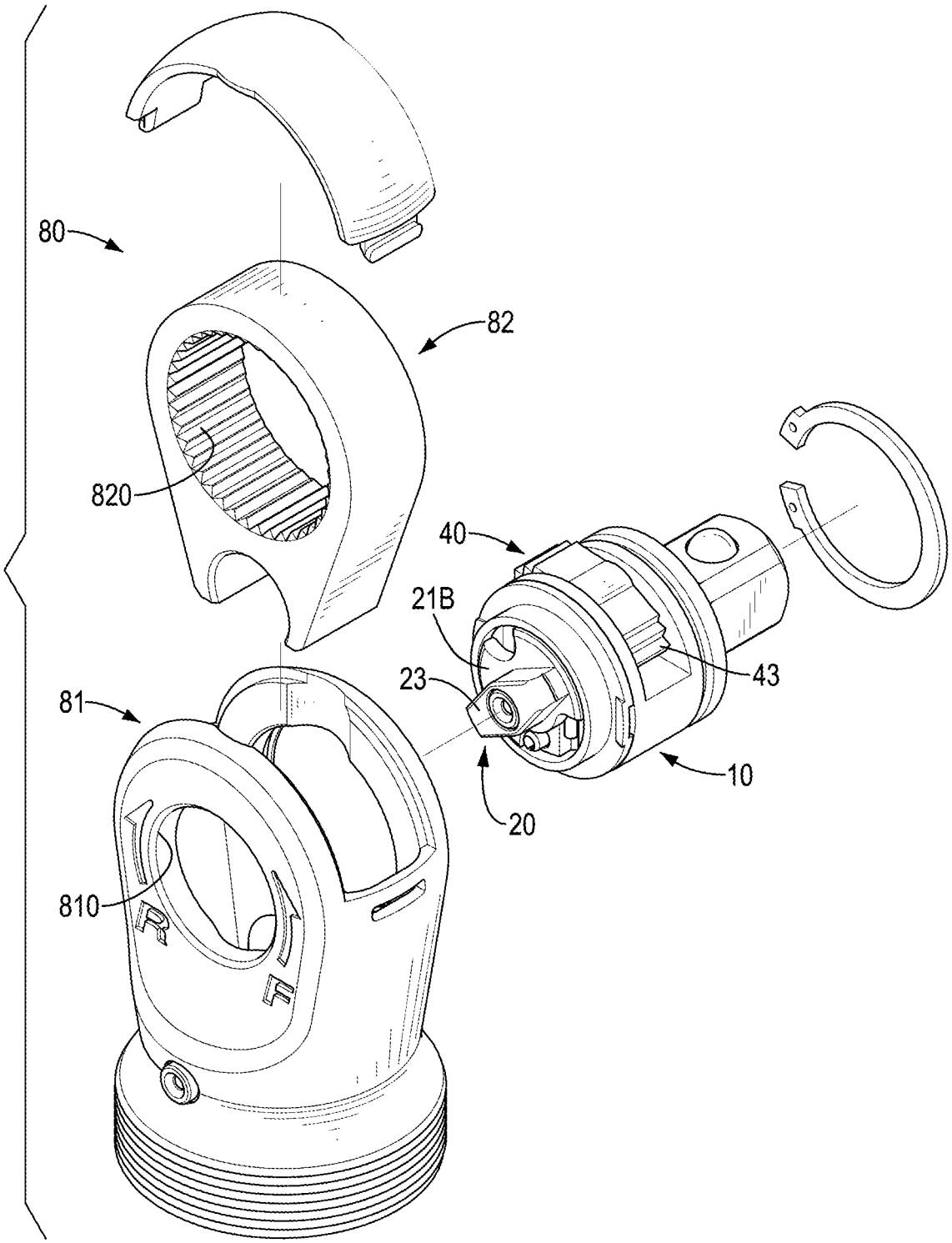
FIG. 3 is a partial exploded perspective view of a ratchet wrench showing the ratchet head in FIG. 1 assembled to the ratchet wrench.
Figure 4:
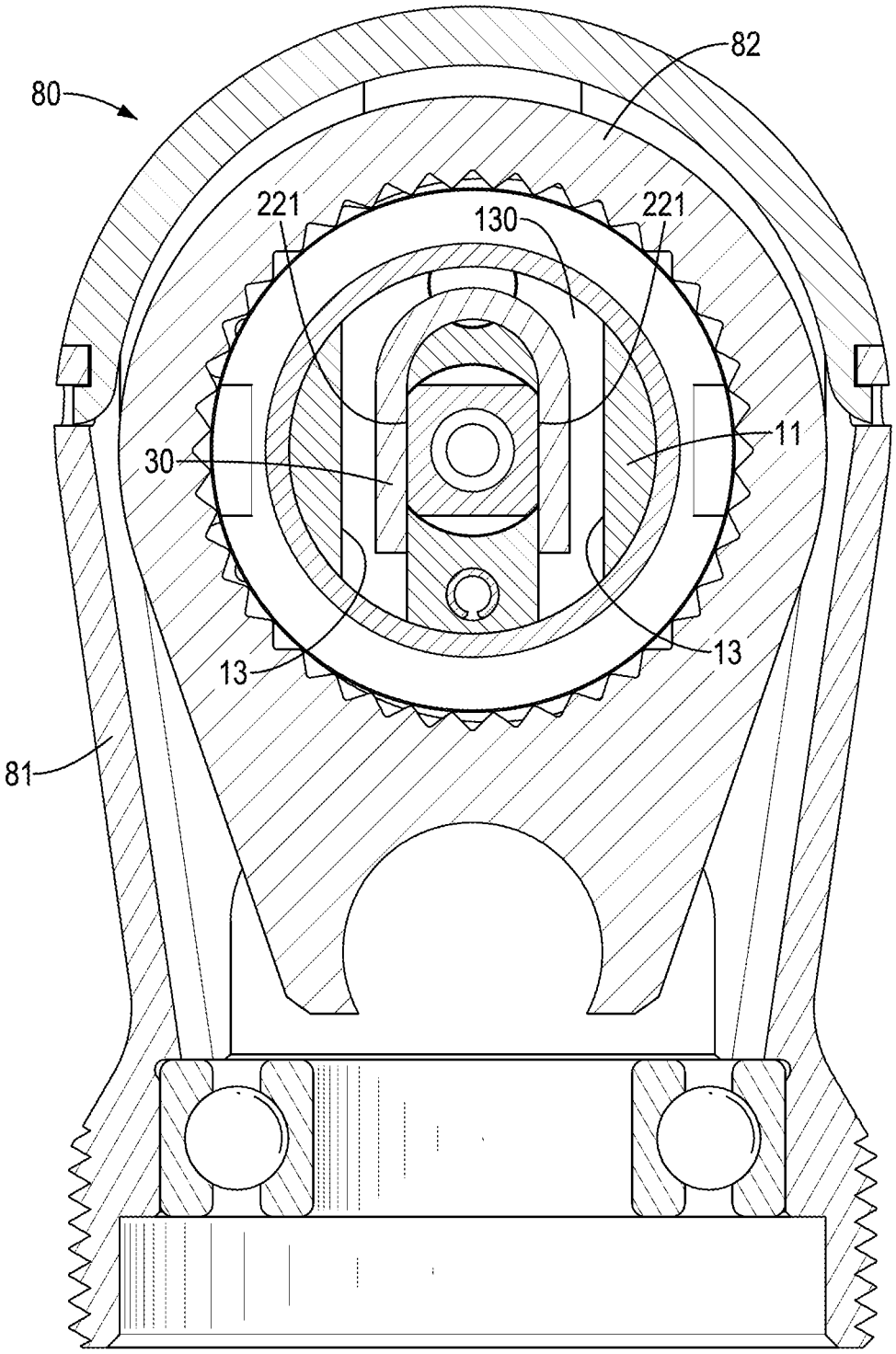
FIG. 4 is an operational cross-sectional side view of the ratchet head assembled to the ratchet wrench in FIG. 3.
Figure 5:
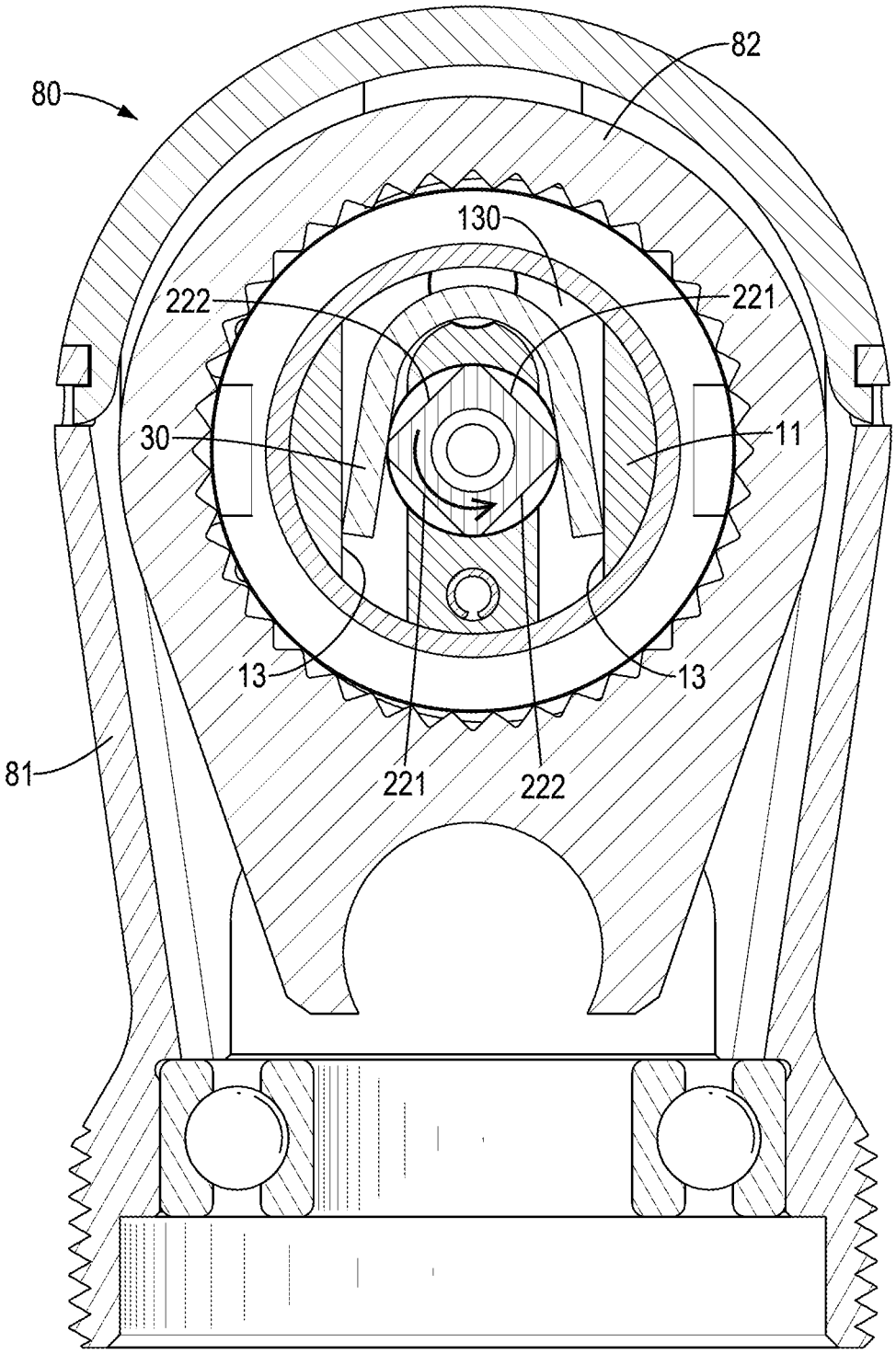
FIG. 5 is another operational cross-sectional side view of the ratchet head assembled to the ratchet wrench in FIG. 3.
Figure 6:
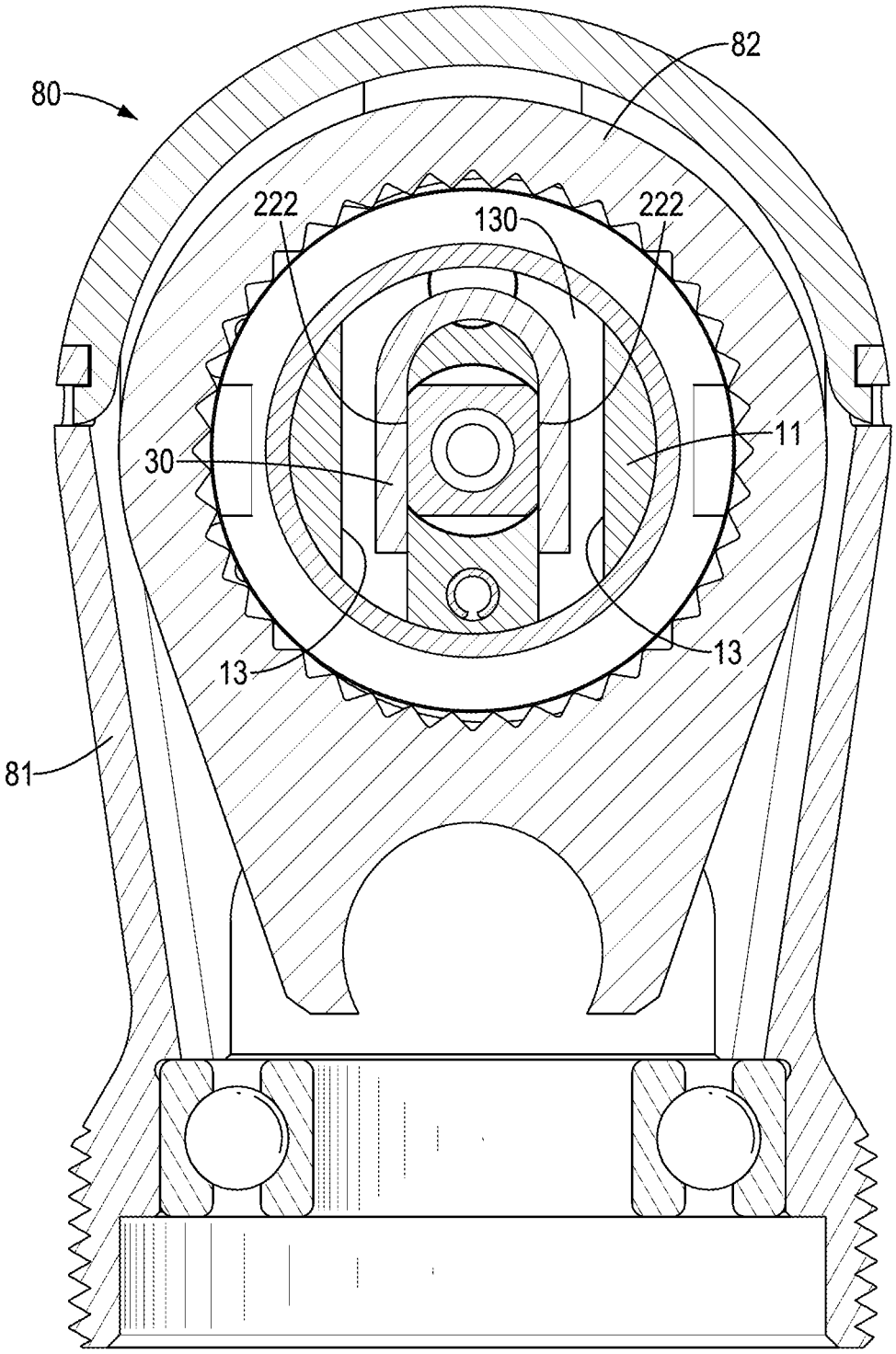
FIG. 6 is further another operational cross-sectional side view of the ratchet head assembled to the ratchet wrench in FIG. 3.
Figure 7:
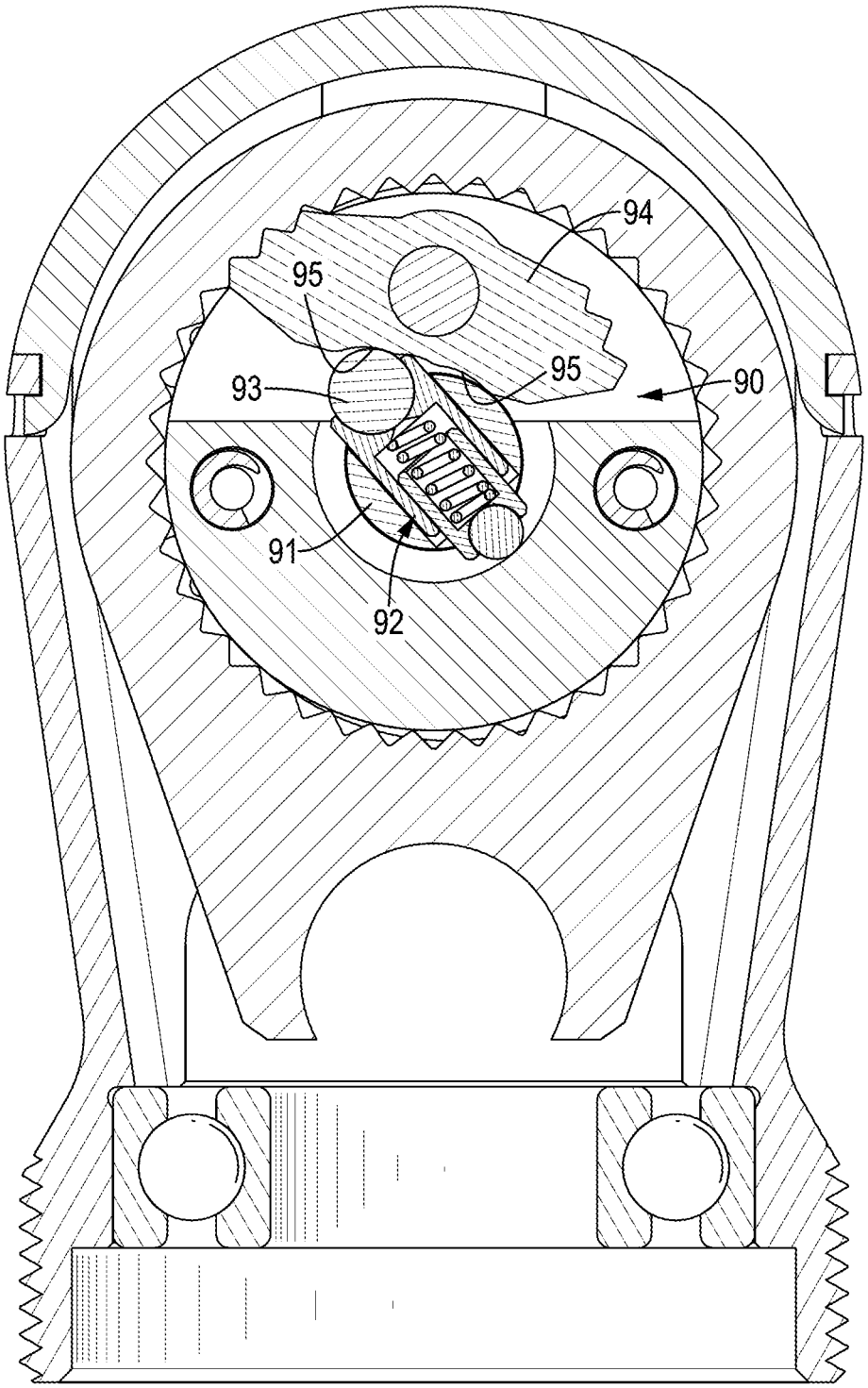
FIG. 7 is an operational cross-sectional side view of a ratchet wrench in accordance with the prior art.
Figure 8:
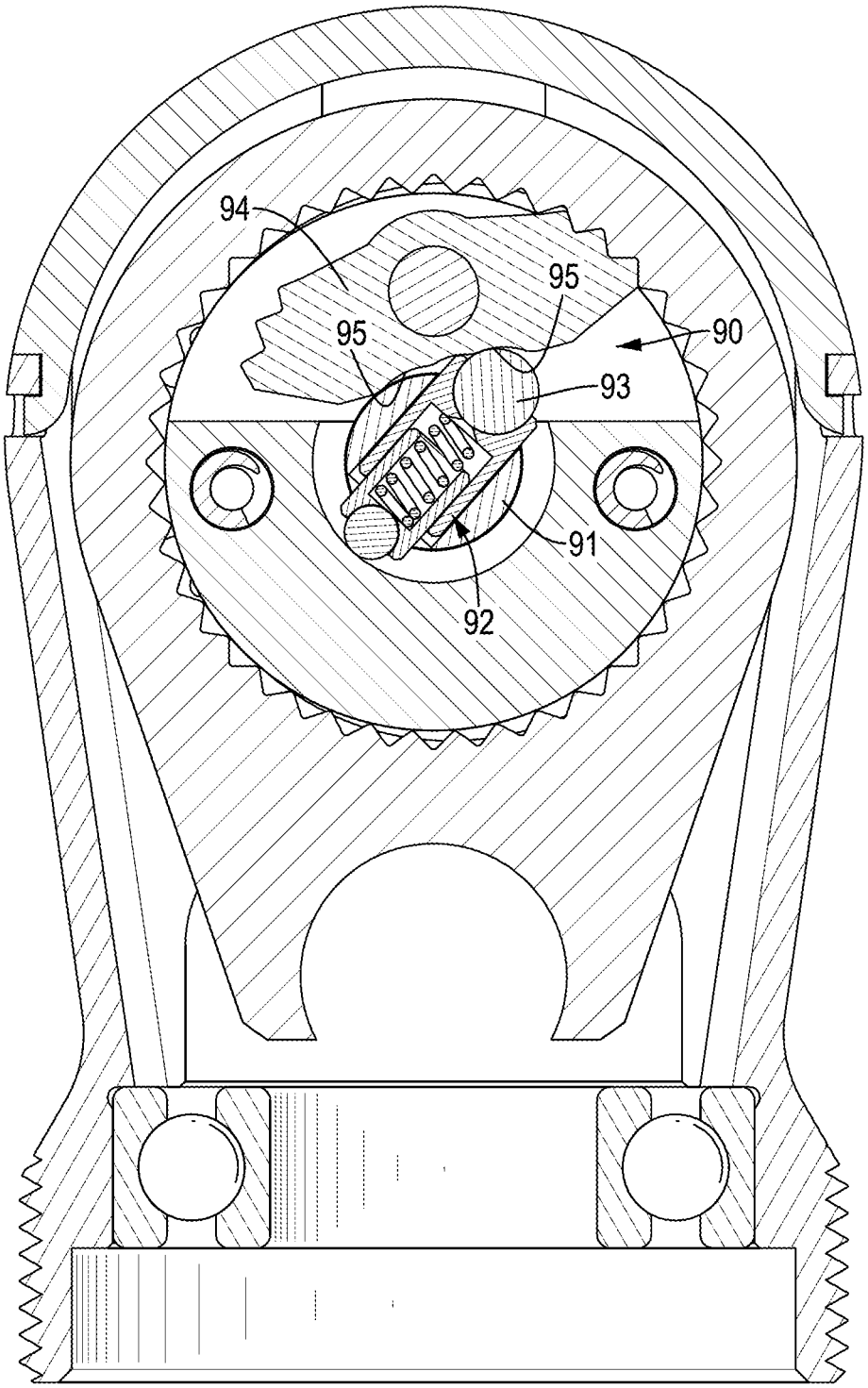
FIG. 8 is another operational cross-sectional side view of the ratchet wrench in FIG. 7.

With reference to FIG. 3, the ratchet head in accordance with the present invention is assembled to a pneumatic ratchet wrench 80 having a housing 81 and a yoke 82. The housing 81 has an opening 810. The yoke 82 is mounted inside the housing 81 and has a circular toothed portion 820 that engages with one of the two toothed portions 43 of the pawl 40. The operating portion 23 extends out of the opening 810 for controlling and switching operating directions.

With reference to FIGS. 1 to 6, the operating portion 23 of the knob 20 is adjusted to rotate for switching the operating directions of the ratchet head. The shaft 22 of the knob 20 rotates relative to the mount 10 and the restricting unit 30. The abutting unit 60 mounted on the shaft 22 rotates with the shaft 22 and selectively abuts against one of the two switching recesses 42 of the pawl 40. One of the toothed portions of the pawl 40 engages with the circular toothed portion 820 of the yoke 82 to restrict the yoke 82 to rotate in a single direction.

The restricting unit 30 is elastic, and the diameter of each one of the two arms of the restricting unit 30 is smaller than the width of the positioning recess 13 in which the arm is mounted. Each one of the two arms of the restricting unit 30 is able to swing in the respective positioning recess 13 when the restricting unit 30 is expanded by the abutting section of the shaft 22 during rotation of the knob 20. On the other hand, when the two arms of the restricting unit 30 abut against the two first abutting faces 211 or the two second abutting faces 222, the shaft 22 is clamped by the two arms of the restricting unit 30 and will not be easily loosened and rotated by vibrations caused by the pneumatic ratchet wrench 80.

The elastic and U-shaped restricting unit 30 is assembled to the mount 10, and the two arms of the restricting unit 30 are respectively mounted in the two positioning recesses 13 of the mount 10. The two arms of the restricting unit 30 may clamp the shaft 22 of the knob 20. And the two arms of the restricting unit 30 may selectively abut against the two first abutting faces 221 or the two second abutting faces 222 of the shaft 22 to prevent the shaft 22 from accidentally rotating due to the vibrations. The restricting unit 30 and the abutting section of the shaft 22 of the ratchet head in accordance with the present invention is a safety switch mechanism that is able to steadily maintain the knob 20 in position, prevent the operating directions of the ratchet head from being accidentally switched, promote operation safety, and prolong service life of the ratchet head.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ratchet head comprising:

a mount having a first lateral face and a second lateral face facing to opposite directions;

a positioning portion protruding from the first lateral face of the mount;

a square drive protruding from the second lateral face of the mount;

an assembling hole defined through a center of the positioning portion and extending parallel to the square drive; and two positioning recesses disposed on both sides of the assembling hole, parallel to each other, and communicating with the assembling hole;

a knob rotatably assembled to the assembling hole of the mount and having a blocking flange abutting against the positioning portion and having an inner surface; and an outer surface;

the inner surface of the blocking flange and the outer surface of the blocking flange facing to opposite directions;

a shaft formed at a center of the inner surface of the blocking flange, inserted in the assembling hole, and having an abutting section formed on a circumference of the shaft, disposed adjacent to the blocking flange, and having two first abutting faces and two second abutting faces disposed at the circumference of the shaft;

the two first abutting faces parallel to each other; and the two second abutting faces parallel to each other; and an operating portion formed on the outer surface of the blocking flange;

a restricting unit with elasticity and having a U-shaped outline; and two arms respectively mounted in the two positioning recesses of the mount, respectively disposed on both sides of the shaft, and respectively abutting the two first abutting faces that respectively face to the two positioning recesses.

2. The ratchet head as claimed in claim 1, wherein each one of the two arms of the restricting unit has a diameter smaller than a width of the positioning recess in which said arm is mounted.

3. The ratchet head as claimed in claim 1, wherein the mount has an inserting hole defined in the positioning portion;

the blocking flange has a limiting recess being curved and disposed according to a position of the inserting hole;

a limiting rod is inserted in the inserting hole and disposed in the limiting recess.

4. The ratchet head as claimed in claim 1, wherein the two positioning recesses communicate with each other to form a U-shaped groove.

5. The ratchet head as claimed in claim 1, wherein the operating portion has a bar-shaped outline.

6. The ratchet head as claimed in claim 1, wherein the mount has a round surface;

a pivoting hole defined in the first lateral face of the mount;

a receiving recess defined in the round surface of the mount, having a semi-circular cross-section, extending along an axial direction of the mount, and communicating with the assembling hole and the pivoting hole;

the shaft of the knob has a hole defined in the circumference of the shaft according to a position of the receiving recess;

a pawl is swingably mounted in the receiving recess of the mount and has a through hole defined through the pawl; and two switching recesses facing to the hole of the shaft of the knob;

a pivoting rod is inserted in the pivoting hole of the mount and the through hole of the pawl;

an abutting unit is disposed in the receiving recess of the mount and has two opposite ends;

one of the two opposite ends of the abutting unit is inserted in the hole of the shaft of the knob; and the other end of the abutting unit abuts against one of the two switching recesses.

7. The ratchet head as claimed in claim 2, wherein the mount has a round surface;

a pivoting hole defined in the first lateral face of the mount;

a receiving recess defined in the round surface of the mount, having a semi-circular cross-section, extending along an axial direction of the mount, and communicating with the assembling hole and the pivoting hole;

the shaft of the knob has a hole defined in the circumference of the shaft according to a position of the receiving recess;

a pawl is swingably mounted in the receiving recess of the mount and has a through hole defined through the pawl; and two switching recesses facing to the hole of the shaft of the knob;

a pivoting rod is inserted in the pivoting hole of the mount and the through hole of the pawl;

an abutting unit is disposed in the receiving recess of the mount and has two opposite ends;

one of the two opposite ends of the abutting unit is inserted in the hole of the knob; and the other end of the abutting unit abuts against one of the two switching recesses.

8. The ratchet head as claimed in claim 3, wherein the mount has a round surface;

a pivoting hole defined in the first lateral face of the mount;

a receiving recess defined in the round surface of the mount, having a semi-circular cross-section, extending along an axial direction of the mount, and communicating with the assembling hole and the pivoting hole;

the shaft of the knob has a hole defined in the circumference of the shaft according to a position of the receiving recess;

a pawl is swingably mounted in the receiving recess of the mount and has a through hole defined through the pawl; and two switching recesses facing to the hole of the shaft of the knob;

a pivoting rod is inserted in the pivoting hole of the mount and the through hole of the pawl;

an abutting unit is disposed in the receiving recess of the mount and has two opposite ends;

one of the two opposite ends of the abutting unit is inserted in the hole of the knob; and the other end of the abutting unit abuts against one of the two switching recesses.

9. The ratchet head as claimed in claim 4, wherein the mount has a round surface;

a pivoting hole defined in the first lateral face of the mount;

a receiving recess defined in the round surface of the mount, having a semi-circular cross-section, extending along an axial direction of the mount, and communicating with the assembling hole and the pivoting hole;

the shaft of the knob has a hole defined in the circumference of the shaft according to a position of the receiving recess;

a pawl is swingably mounted in the receiving recess of the mount and has a through hole defined through the pawl; and two switching recesses facing to the hole of the shaft of the knob;

a pivoting rod is inserted in the pivoting hole of the mount and the through hole of the pawl;

an abutting unit is disposed in the receiving recess of the mount and has two opposite ends;

one of the two opposite ends of the abutting unit is inserted in the hole of the knob; and the other end of the abutting unit abuts against one of the two switching recesses.

10. The ratchet head as claimed in claim 5, wherein the mount has a round surface;

a pivoting hole defined in the first lateral face of the mount;

a receiving recess defined in the round surface of the mount, having a semi-circular cross-section, extending along an axial direction of the mount, and communicating with the assembling hole and the pivoting hole;

the shaft of the knob has a hole defined in the circumference of the shaft according to a position of the receiving recess;

a pawl is swingably mounted in the receiving recess of the mount and has a through hole defined through the pawl; and two switching recesses facing to the hole of the shaft of the knob;

a pivoting rod is inserted in the pivoting hole of the mount and the through hole of the pawl;

an abutting unit is disposed in the receiving recess of the mount and has two opposite ends;

one of the two opposite ends of the abutting unit is inserted in the hole of the knob; and the other end of the abutting unit abuts against one of the two switching recesses.

11. The ratchet head as claimed in claim 6, wherein the blocking flange has a connection recess arranged according to a position of the pivoting hole; and the pivoting rod which is inserted in the pivoting hole of the mount and the through hole of the pawl passes through the connection recess.

* * * * *